US006932723B1

(12) United States Patent
Klinger et al.

(10) Patent No.: US 6,932,723 B1
(45) Date of Patent: Aug. 23, 2005

(54) BASKETBALL SHOOTING ACCURACY AID

(76) Inventors: Ryan Klinger, 6049 Cedar St., Fennville, MI (US) 49408; Michael McFarland, 6049 Cedar St., Fennville, MI (US) 49408

( * ) Notice: Subject to any disclaimer, the term of this patent is extended or adjusted under 35 U.S.C. 154(b) by 0 days.

(21) Appl. No.: 10/684,458

(22) Filed: Oct. 14, 2003

(51) Int. Cl.[7] ..... A63B 69/00
(52) U.S. Cl. ..... 473/448; 473/422; 473/433
(58) Field of Search ..... 473/422, 432–436, 473/447, 448, 472, 479–481, 484, 489; 273/317.3

(56) References Cited

U.S. PATENT DOCUMENTS 1,904,836 A 4/1933 Peoples
2,708,576 A 5/1955 Verkuilen
3,160,414 A * 12/1964 Gray ..... 473/448
4,206,915 A * 6/1980 Woodcock ..... 473/448
4,836,539 A * 6/1989 Knapp ..... 473/433
5,165,680 A * 11/1992 Cass ..... 473/433
5,207,789 A 5/1993 Gates
5,308,059 A 5/1994 Owen, Jr. et al.
5,364,092 A 11/1994 Riepe et al.
D368,942 S * 4/1996 Mahoney ..... D21/781
5,558,323 A 9/1996 LoFaso, Sr.
5,823,896 A 10/1998 Pearsall
2004/0043841 A1 * 3/2004 Williams ..... 473/448

* cited by examiner

*Primary Examiner*—Mitra Aryanpour

(57) ABSTRACT

A basketball shooting accuracy aid includes a loop member including a top edge, a bottom edge and a peripheral wall extending between the top and bottom edges. The peripheral wall has an inner surface and an outer surface. The loop member has circular shape. An inner diameter of the loop member is at least one inch less than an inner diameter of a basketball rim. A bracket is attached to the loop member and is positioned adjacent to the bottom edge for selectively securing the loop member to the rim such that the loop member extends upwardly above a plane of the rim.

8 Claims, 4 Drawing Sheets

BASKETBALL SHOOTING ACCURACY AID

BACKGROUND OF THE INVENTION

1. Field of the Invention

The present invention relates to basketball accuracy improvement devices and more particularly pertains to a new basketball accuracy improvement device for improving the basketball shooting accuracy of a basketball player.

2. Description of the Prior Art

The use of basketball accuracy improvement devices is known in the prior art. U.S. Pat. Nos. 5,364,092 and 5,823,896 both describe devices that decrease the diameter of a basketball rim so that making a basketball shot is more difficult. Other types of improvement devices include additional hoops through which the basketball must travel before it travels through the basketball rim. Such a device is found in U.S. Pat. No. 5,558,323.

While these devices fulfill their respective, particular objectives and requirements, the need remains for a device that not only decreases the diameter of the rim but also discourages bank shots by decreasing reliance on the backboard of the basketball hoop. The combination of these two features will increase the accuracy of shooting a basketball.

SUMMARY OF THE INVENTION

The present invention meets the needs presented above by generally comprising a loop member including a top edge, a bottom edge and a peripheral wall extending between the top and bottom edges. The peripheral wall has an inner surface and an outer surface. The loop member has circular shape. An inner diameter of the loop member is at least one inch less than an inner diameter of a basketball rim. A bracket is attached to the loop member and is positioned adjacent to the bottom edge for selectively securing the loop member to the rim such that the loop member extends upwardly above a plane of the rim.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
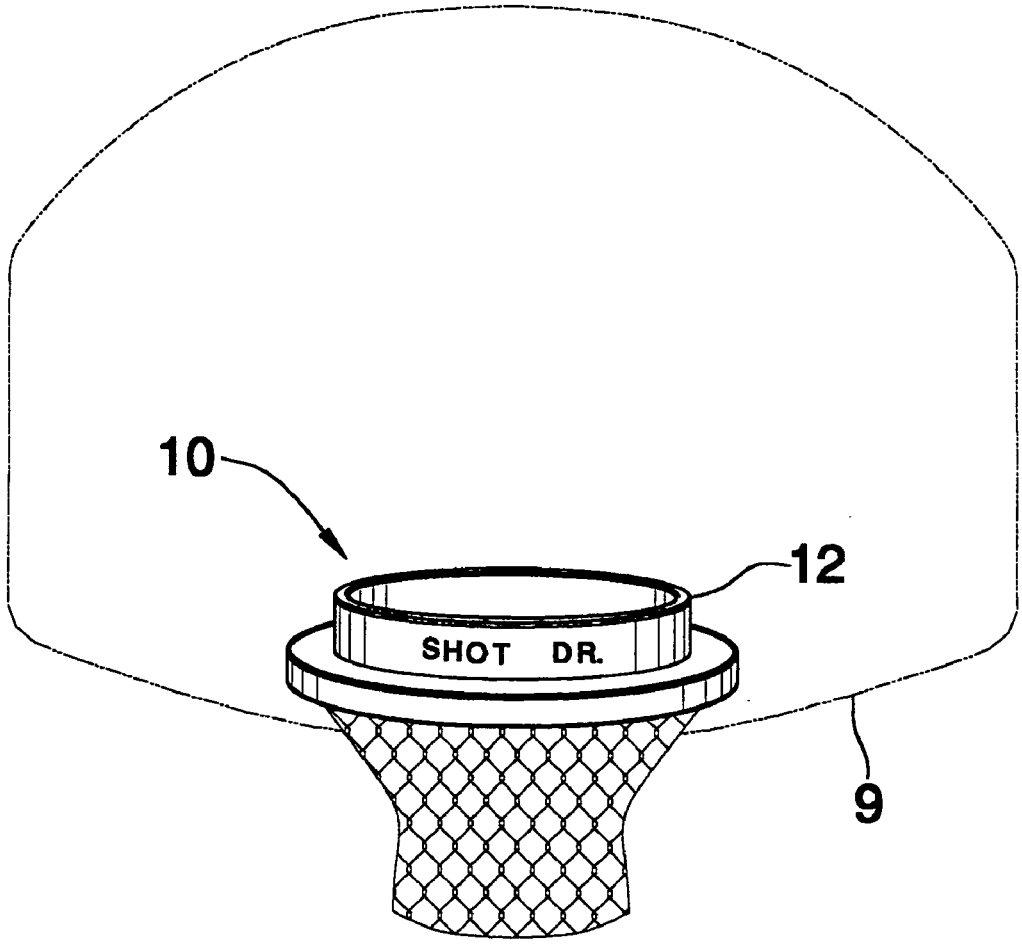
FIG. 1 is a schematic front perspective view of a basketball shooting accuracy aid according to the present invention.
Figure 2:
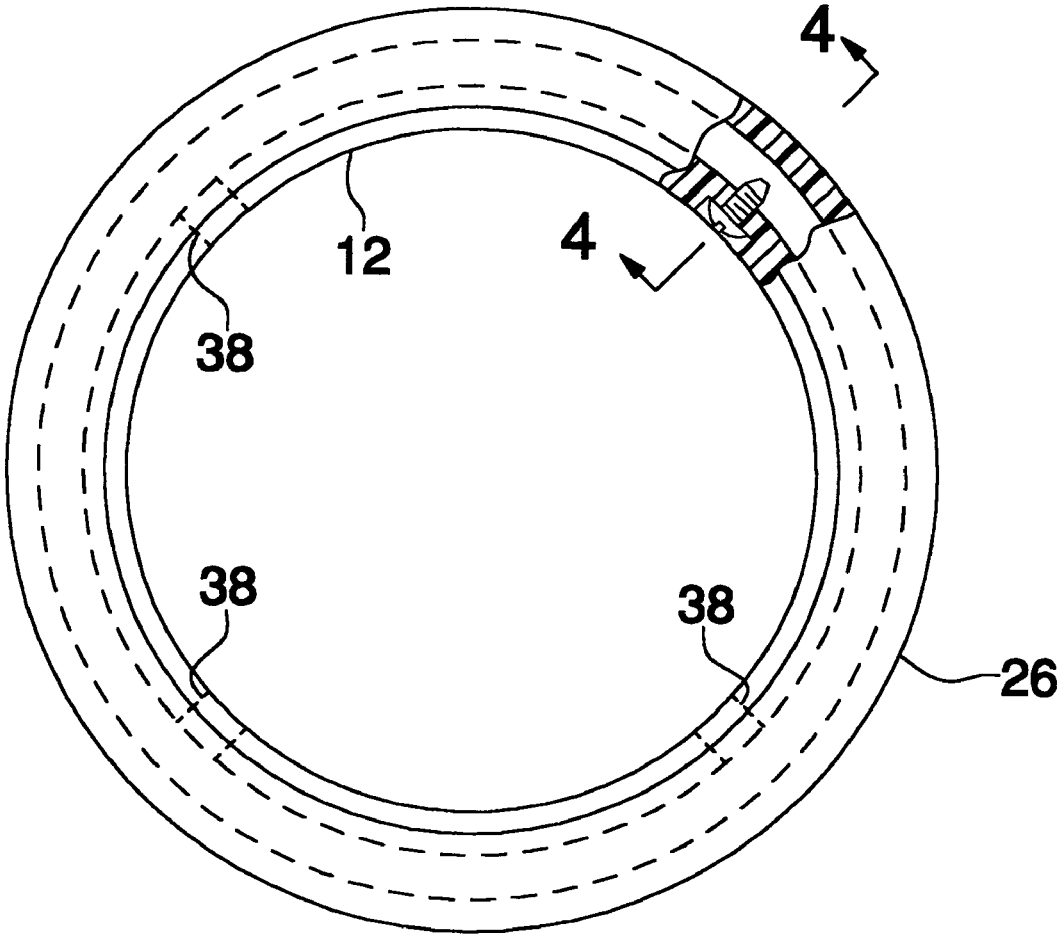
FIG. 2 is a schematic top view of the present invention.
Figure 3:
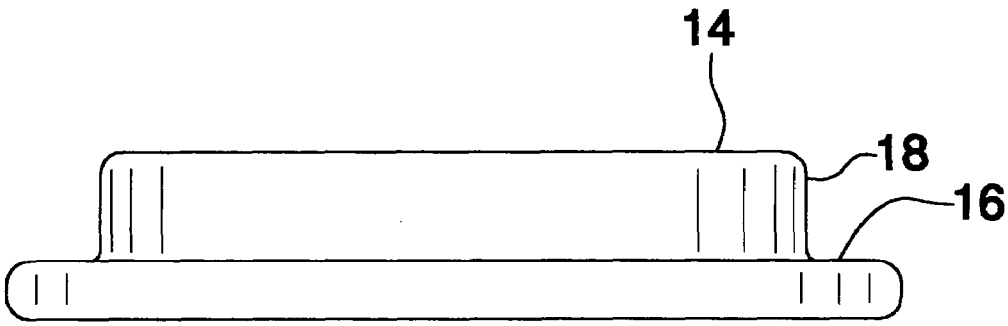
FIG. 3 is a schematic front view of the present invention.
Figure 4:
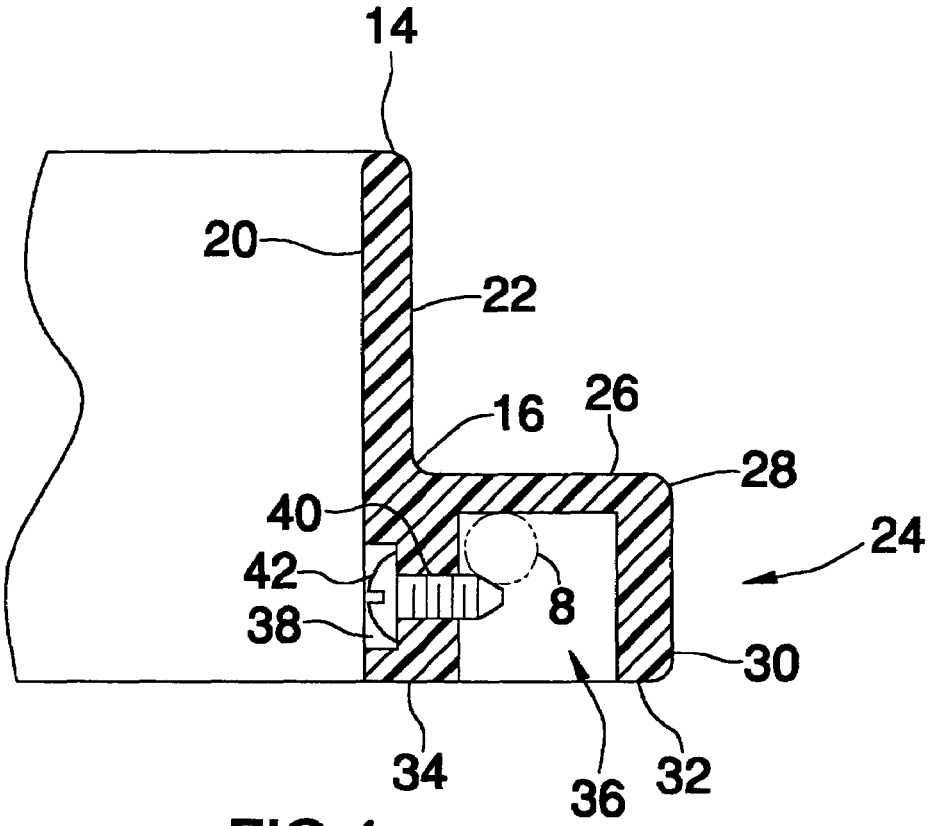
FIG. 4 is a schematic cross-sectional view taken along line 4—4 of FIG. 2 of the present invention.

With reference now to the drawings, and in particular to FIGS. 1 through 6 thereof, a new basketball accuracy improvement device embodying the principles and concepts of the present invention and generally designated by the reference numeral 10 will be described.

As best illustrated in FIGS. 1 through 6, the basketball shooting accuracy aid 10 generally comprises a loop member 12 including a top edge 14, a bottom edge 16 and a peripheral wall 18 extending between the top 14 and bottom 16 edges. The peripheral wall 18 has an inner surface 20 and an outer surface 22. The loop member 12 has circular shape. An inner diameter of the loop member 12 is at least one inch less than an inner diameter of a regulation basketball rim 8 which is equal to 18 inches. Ideally, the inner diameter of the loop member 12 is substantially equal to 16.5 inches. The loop member 12 has a width from the inner surface 20 to the outer surface 22 of about ¼ inch. The upper edge 14 of the loop member 12 is rounded.

A bracket 24 is attached to the loop member 12 and is positioned adjacent to the bottom edge 16 for selectively securing the loop member 12 to the rim 8 such that the loop member 12 extends upwardly above a plane of the rim 8. The peripheral wall 18 extends at least three inches upwardly from the bracket 24. The bracket 24 includes an outwardly extending peripheral flange 26 that is attached to the peripheral wall 18. The peripheral flange 26 has an outer edge 28. A downwardly extending first wall 30 is attached to and extends along a length of the outer edge 28. The juncture of the flange 26 and the first wall 30 is rounded and it is also preferred that a bottom edge 32 of the first wall 30 is rounded. A downwardly extending second wall 34 is attached to and extends along a length of the bottom edge 16. A rim receiving space 36 is defined between the first wall 30 and the second wall 34. The second wall 34 has a plurality of apertures 38 extending therethrough. Each of a plurality of fasteners 40 is removably extendable into one of the apertures 38 such that the fasteners 40 extend into the rim receiving space 36 and the rim 8 is positioned between the flange 26 and the fasteners 40. The fasteners 40 each have a head 42 that is countersunk into the second wall 34 such that the heads 42 are flush with an inner side of the second wall 34. The plurality of apertures 38 and fasteners 40 is preferably at least four of each.

Figure 5:
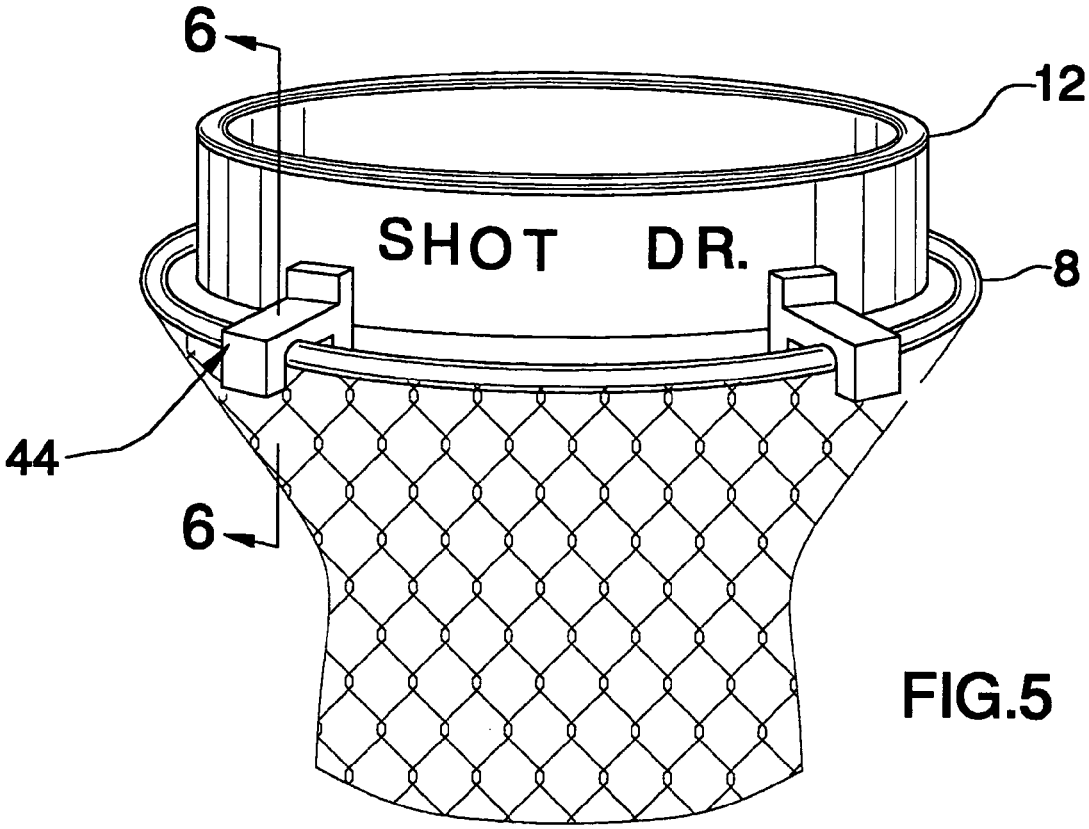
FIG. 5 is a schematic front perspective view of a second embodiment of the present invention.
Figure 6:
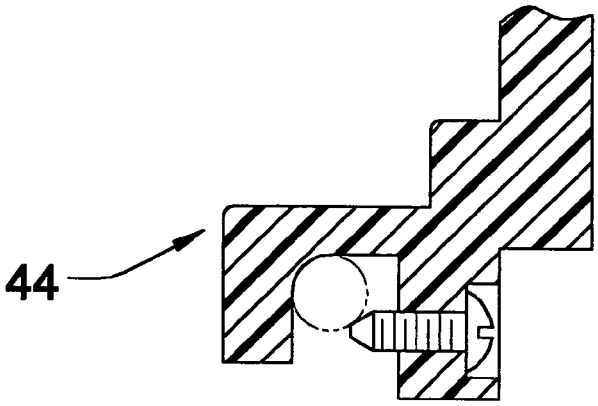
FIG. 6 is a schematic cross-sectional view taken along line 6—6 of FIG. 5 of the present invention.

A second version of the bracket 44 is depicted in FIGS. 5 and 6 and includes a substantially similar structure as that described above, however the bracket 44 of the second embodiment is a plurality of discrete brackets 44 spaced around the peripheral wall 18.

In use, the aid 10 is positioned on a conventional basketball rim 8 to decrease the inner circumference of the rim 8. The user of the aid 10 then attempts to shoot baskets in a conventional manner. The smaller diameter encourages more precise shooting in order to make a basket. The peripheral wall 18, being three inches above the bracket 24, adds difficulty when attempting a bank-shot off of a backboard 9. Because of the peripheral wall 18, a shooter is required to make more shots without the use of the backboard 9, again to encourage more accurate and precise shooting. The rounded edges 14, 28, 32 of the aid 10 insure rebounds off of the aid that follow conventional trajectories off of rim 8 and also prevents damage to the basketball.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A basketball shooting training device comprising:

a basketball rim;

a loop member including a top edge, a bottom edge and a peripheral wall extending between said top and bottom edges, said peripheral wall having an inner surface and an outer surface, said loop member having circular shape, an inner diameter of said loop member being at least one inch less than an inner diameter of the rim; and a bracket being attached to and extending around said loop member and being positioned adjacent to said bottom edge for selectively securing said loop member to the rim such that said loop member extends upwardly above a plane of the rim, said peripheral wall being orientated generally perpendicular to the plane of the rim, said bracket including;

an outwardly extending peripheral flange being attached to said peripheral wall, said peripheral flange having an outer edged;

a downwardly extending first wall being attached to and extending along a length of said outer edge;

a downwardly extending second wall being attached to and extending along a length of said bottom edge, a rim receiving space being defined between said first wall and said second wall, said second wall having a plurality of apertures extending therethrough; and a plurality of fasteners, each of a plurality of fasteners being removably extendable into one of said apertures such that said fasteners extend into said rim receiving space and said rim is positioned between said flange and said fasteners, said rim being positioned over and abutting said fasteners.

2. The device of claim 1, wherein said peripheral wall extends at least three inches upwardly from said bracket.

3. The device of claim 2, wherein said inner diameter of said loop member being substantially equal to 16.5 inches.

4. The device of claim 3, wherein said loop member has a width from said inner surface to said outer surface of about ¼ inch.

5. The device of claim 4, wherein said top edge is rounded.

6. The device of claim 1, wherein a head of each of said fasteners is flush with an inner side of said second wall.

7. The device of claim 6, wherein a juncture of said first wall and said flange is rounded.

8. A basketball shooting training device for removably positioning on a basketball rim, said device comprising:

a loop member including a top edge, a bottom edge and a peripheral wall extending between said top and bottom edges, said peripheral wall having an inner surface and an outer surface, said loop member having circular shape, an inner diameter of said loop member being at least one inch less than an inner diameter of the rim, said inner diameter of said loop member being substantially equal to 16.5 inches, said loop member having a width from said inner surface to said outer surface of about ¼ inch;

a bracket being attached to and extending around said loop member and being positioned adjacent to said bottom edge for selectively securing said loop member to the rim such that said loop member extends upwardly above a plane of the rim, said peripheral wall being orientated generally perpendicular to said plane of said rim, said peripheral wall extending at least three inches upwardly from said bracket, said bracket including;

an outwardly extending peripheral flange being attached to said peripheral wall, said peripheral flange having an outer edge;

a downwardly extending first wall being attached to and extending along a length of said outer edge;

a downwardly extending second wall being attached to and extending along a length of said bottom edge, a rim receiving space being defined between said first wall and said second wall, said second wall having a plurality of apertures extending therethrough; and a plurality of fasteners, each of a plurality of fasteners being removably extendable into one of said apertures such that said fasteners extend into said rim receiving space and said rim is positioned between said flange and said fasteners, said rim being positioned over and abutting said fasteners, a head of each of said fasteners being flush with an inner side of said second wall.

* * * * *